United States Patent [19]

Hunter

[11] 4,297,868

[45] Nov. 3, 1981

[54] PIPE SIZING AND GROOVING APPARATUS

[76] Inventor: John J. Hunter, 1410 Willow Pond, Abilene, Tex. 79602

[21] Appl. No.: 81,778

[22] Filed: Oct. 4, 1979

[51] Int. Cl.[3] ..... B21D 39/04

[52] U.S. Cl. ..... 72/402; 29/517

[58] Field of Search ..... 72/402, 367, 452, 391; 29/517, 508, 510, 516, 237

[56] References Cited

U.S. PATENT DOCUMENTS

| | | | |
|---|---|---|---|
| 3,029,665 | 4/1962 | Baugh | 72/402 |
| 3,156,139 | 11/1964 | Willis | 72/402 |
| 3,421,562 | 1/1969 | Orloff | 29/517 |
| 3,803,793 | 4/1974 | Dahl | 29/517 |
| 4,012,828 | 3/1977 | Dahl | 29/517 |

*Primary Examiner*—Gene P. Crosby
*Attorney, Agent, or Firm*—Kanz & Timmons

[57] ABSTRACT

Disclosed is apparatus for forming an annular groove or recess in the external surface of a pipe section at a predetermined distance from the open end of the pipe. The grooving apparatus comprises a cylindrical body with a tapered external surface at one end, the external diameter of the tapered end increasing with axial distance from the open end. An inwardly projecting lip is formed on the internal surface of the grooving tool and axial slots cut into the tapered surface and the lip. The grooving tool cooperates with a sizing tool having a correspondingly tapered internal surface. The open end of a pipe section is forced through the sizing tool to form a sized end portion of predetermined length. The grooving tool is then forced axially into the sizing tool radially compressing the tapered surface of the grooving tool and deforming the inwardly projecting lip on the internal surface thereof into the pipe to form an annular groove or recess in the external surface of the pipe at a predetermined distance from the open end of the sized pipe.

6 Claims, 5 Drawing Figures

PIPE SIZING AND GROOVING APPARATUS

This invention relates to apparatus for sizing the open end of malleable tubular materials such as metal pipe and the like and simultaneously forming an annular groove in the external surface of the pipe at a predetermined distance from the open end thereof. More particularly, it relates to apparatus for sizing the open end of a pipe or the like which operates an cooperation with a forming die to form a groove in the external surface of the pipe.

Various methods have been used for joining lengths of pipe to form a continuous conduit. Perhaps the most common pipe joining method involves the joining of an externally threaded pin end of one pipe section with an internally threaded box end of another pipe section. The interconnection is generally called a joint and in the case of threaded ends is called a threaded joint.

While satisfactory for many purposes, threaded pipe joints are relatively expensive to prepare and considerable time is required to form a junction therebetween. For example, at least one of the lengths of pipe must be rotated to join two threaded pipe lengths, thereby rendering it difficult if not impossible to join two relatively long lengths of pipe with conventional threaded ends.

For forming conduits in which the pressure of the fluid to be conducted through the pipe is relatively low, various types of non-threaded joints have been devised. Non-threaded joints are typically formed by enlarging the internal diameter of one end of the pipe section to a diameter slightly less than the external diameter of the pipe. The enlarged end is commonly referred to as a bell and the end of the adjoining pipe which fits within the bell is commonly referred to as the pin end or spigot. Conventionally, the bell is formed by forcing a mandrel of desired shape into one end of the pipe to form a bell of enlarged dimensions with a flared end so that the pin end of another pipe section may be inserted into the flared portion and forced into the remaining portion of the bell. Such joints are referred to as interference fit joints and are commonly used in applications wherein the pressure of the fluid passing through the conduit is relatively low, such as, for example, automobile exhaust pipes and the like. Since the internal diameter of the bell is less than the external diameter of the pin, the bell must be slightly expanded radially as the pin is axially inserted therein. The difference in diameters is conventionally known as the interference and the friction between the walls interference fitted together forms the joint or coupling force.

One of the main advantages of interference fit joints is that they may be formed relatively quickly and inexpensively and neither pipe section need be rotated to form the junction. Furthermore, since excessive heat is not required to form an interference fit joint, pipe sections with internal plastic linings may be formed with appropriately designed ends on the plastic liner which mate or overlap in some manner to form a fully lined conduit on assembly. Among the disadvantages of conventional interference fit joints is that the joint is usually incapable of withstanding high pressures and will either leak or separate if the joint is subjected to high internal pressures.

It has been discovered that the integrity of interference fit joints can be vastly improved by radially compressing the mouth of the bell inwardly after the joint is formed to form and mate with an annular groove in th pin end, thus mechanically interlocking the two pipe sections. However, when the mouth of the bell is compressed into the pin to form an external annular groove, a corresponding annular inwardly projecting bulge is formed on the internal surface of the pin end of the pipe. If the internal surface of the pipe is coated with a protective liner, particularly spray coated plastic liners and the like, crimping the bell into the pin sufficiently to form an interlocking groove distorts and ruptures the plastic liner. Thus, even though a fully lined joint is formed, the liner is dislodged from the pipe wall in the area of the crimp and fluid passing through the conduit may contact the metal pipe through ruptures in the internal lining.

In forming interference fit joints, it is important that the amount of interference be controlled. Since the bell is formed by expanding the end of the pipe to the desired dimensions, the bell end is usually uniformly of the dimensions desired. However, the external diameter of pipe may vary slightly from mill to mill and from lot to lot, even though the pipe is sold as having standard dimensions. Likewise, the pipe may not be perfectly circular in cross section. Even new pipe is often somewhat oval in cross section and used pipe may be severely distorted or corroded on the external surface. For these reasons it is desirable that the pin end of the pipe be sized to the desired dimensions to remove mill scale, corrosion and the like and to insure that the external diameter of the pin is uniformly circular in cross section and uniformly larger than the internal diameter of the bell so that a uniform interference will be formed and galling will be prevented.

Sizing is conventionally performed by forcing a sizing collar over the pin end which has internal dimensions corresponding to the desired external dimensions of the pin. When the internal surface of the pipe is to be coated with a plastic liner, the belling and sizing operations are performed on the ends of the pipe prior to forming the internal coatings and the terminal ends of the liners suitably shaped to provide mating or overlapping surfaces which form a continuous plastic liner through the joint when the joint is properly assembled.

In accordance with the present invention, a sizing tool is provided which cooperates with a crimping or grooving tool to correctly size the pin end of a pipe to the desired dimensions and form an annular groove or recess in the external surface of the pipe at a predetermined distance from the open end thereof. Accordingly, the pre-sized and pre-grooved pin may be forced into a bell of the correct dimensions to form an interference fit joint and the mouth of the bell deformed inwardly into the pre-formed groove to form an interlocking joint without disturbing any liner formed or placed within the pipe. Since the groove is formed prior to forming the liner within the pipe, adherence of the liner to the inner wall of the pipe is not disturbed in forming the joint. Furthermore, since the annular groove is formed at a predetermined distance from the open end, completion of an interference fit joint using a bell with the same predetermined bell depth may be visually observed, thus assuring that each joint is uniformly formed and that internal liner ends are properly overlapped or otherwise joined to form a fully lined conduit. Since the groove into which the mouth of the bell is to be depressed is formed prior to formation of the interference fit joint, the mouth of the bell may be more readily deformed into the pre-existing groove, thus reducing the crimping forces required to form an interlocking joint.

Other advantages and features of the invention will become more readily understood from the following detailed description taken in connection with the appended claims and attached drawings in which:

Figure 1:
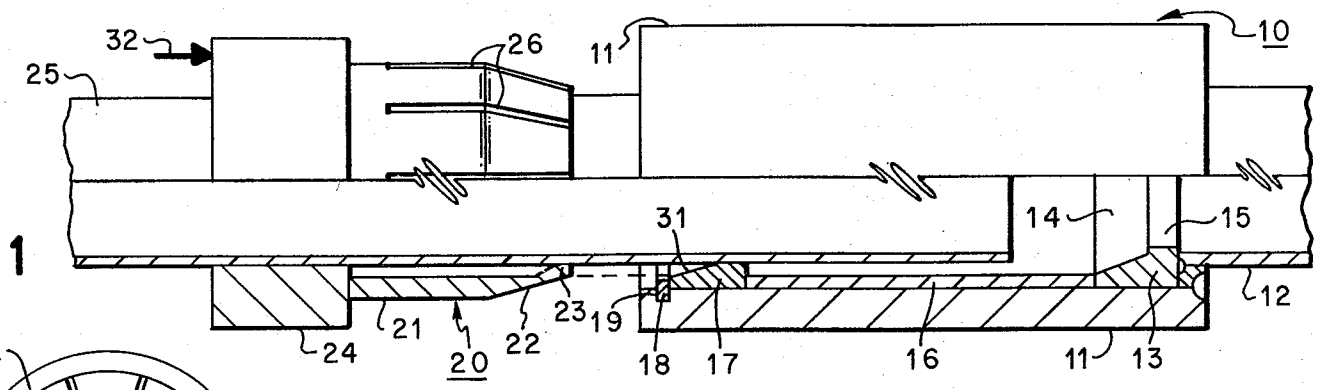
FIG. 1 is a partially elevational and partially sectional view of the preferred embodiment of the sizing and grooving apparatus of the invention shown in place on the end of a pipe section.
Figure 3:
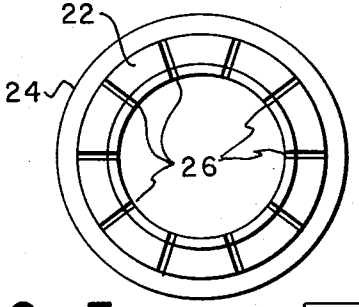
FIG. 3 is an end view of the grooving tool shown in FIG. 1.
Figure 4:
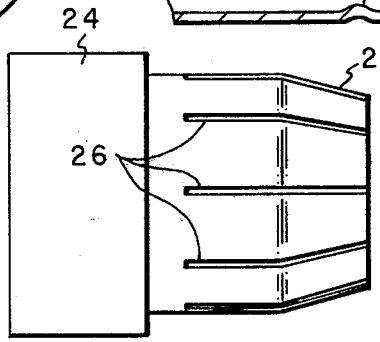
FIG. 4 is a elevational view of the grooving tool shown in FIG. 1.

As illustrated in FIG. 1, the apparatus of the invention includes a sizing tool (generally indicated at 10) and a grooving tool (generally indicated at 20). The grooving tool 20, as illustrated in FIGS. 1, 3 and 4, comprises and open-ended cylindrical body 21 with an inwardly tapered external surface 22 adjacent one end thereof. The internal diameter of the grooving tool is somewhat larger than the external diameter of the pipe except at the ends thereof. As shown in FIG. 1, an inwardly projecting lip 23 is formed on the internal surface of the tapered end of the tool 20. The opposite end of the body 21 mates with a cylindrical collar 24 which has an internal diameter only slightly larger than the external diameter of the pipe 25. Collar 24 may be formed as an integral part of the grooving tool 20 or may be a separate collar. The internal diameter of collar 24 must be sufficiently larger than the external diameter of the pipe 25 to allow the collar to slide over the pipe 25 when axial force is applied thereto. The grooving tool is thus concentrically positionable and axially moveable over the pipe section 25.

Longitudinal slots 26 are formed in the tapered end of the cylinder 21. The slots 26 thus divide the tapered end of the cylinder into a plurality of axially projecting individual fingers surrounding the pipe 25 with lips 23 contacting the outer surface of the pipe 25.

The sizing tool 10 comprises a cylindrical body 11 mounted on an axial post 12. The internal diameter of the cylinder 11 is considerably larger than the external diameter of the pipe 25. A ring 13 is positioned concentrically within the cylinder 11 at the end thereof adjacent the post 12. The outer diameter of ring 13 conforms to the inner diameter of cylinder 11 and at least the portion of the internal diameter of ring 13 opposite the post 12 is tapered. The tapered internal surface 14 is tapered inwardly from the edge thereof. The largest diameter (the diameter adjacent the open edge of the ring) is greater than the external diameter of the open end of pipe 25. The tapered surface 14 tapers inwardly to a diameter less than the external diameter of pipe 25. The opposite edge of ring 13 may form a closed surface or have at least an inwardly projecting flange 15.

A spacing cylinder 16 having an internal diameter substantially larger than the external diameter of the pin end of pipe 25 and an external diameter substantially conforming to the internal diameter of the cylinder body 11 is telescopically inserted axially within the cylindrical body 11 abutting the open edge of the ring 13.

A sizing ring 17 having an external diameter conforming to the internal diameter of the cylindrical body 11 is inserted within the open end of cylinder 11 and abutting the opposite end of spacing cylinder 16. The sizing ring 17 (and thus the entire internal assembly within cylindrical body 11) is held in place by a retaining ring 18 which fits within a groove 19 in the internal surface of the cylindrical body 11. The internal surface 31 of sizing ring 17 is tapered inwardly from a diameter substantially larger than the external diameter of the pin end of pipe 25 to an internal diameter corresponding to the desired size and shape of the pin end of the pipe 25.

To size and groove the pipe 25 in accordance with the invention, the grooving tool 20 is positioned on the external surface of the pin end of the pipe with the tapered surface 22 nearest the open end of the pipe. The tool 20 is advanced over the pipe a substantial distance to avoid interference with the initial sizing operation. The pipe 25 is then telescopically inserted within the sizing tool 10. It will be observed that as the end of the pipe 25 is telescopically inserted within the sizing tool 10, the pipe will engage the tapered surface 31 of the sizing ring 17. As the pipe advances through the sizing ring 17, the external surface of the pipe is reshaped and sized to the internal diameter of the sizing ring 17. Thus if the external diameter of the pipe 25 is originally larger than the internal diameter of the sizing ring 17, or if the pipe is elipitical in cross section, the pipe will be reshaped to the circular dimensions and size of the internal surface of the sizing ring as it is forced through the sizing ring 17. Furthermore, mill scale, rust, corrosion or the like will be removed from the pipe as it is forced through the sizing ring 17. When the open end of pipe 25 engages the tapered surface 14 of ring 13, the end of the pipe 25 will be radially inwardly compressed to form a slightly inwardly tapered end portion **25*a* as shown in FIG. 2**.

In the preferred embodiment the ring 13 is proportioned so that the pipe may be advanced into the sizing tool 10 until the end of the pipe 25 strikes flange 15. At this point a known length of the pin end of the pipe will be sized to the desired dimensions and the open end of the pipe 25 will be slightly inwardly compressed to form tapered end **25*a* of the desired dimensions. With the pipe 25 fully inserted within the sizing tool 10 and the open end of the pipe resting against flange 15, axial force is applied to collar 24 as indicated by arrow 32. Grooving tool 20 is thus telescopically inserted within the sizing tool 10 and tapered surfaces 22 on the fingers engage the tapered surface 31 on the sizing ring 17. As the grooving tool 20 is forced into the sizing tool 10, the lips 23 on the internal surface of the fingers of the grooving tool are radially inwardly compressed, deforming the fingers inwardly and toward each other until the slots 26 are closed at the open end of the sizing tool 20. By compressing the lips 23 radially inwardly a groove 33, as illustrated in FIG. 2, is formed in the external surface of pipe 25. The sizing tool 10 is then removed from the pipe 25 allowing the fingers of the grooving tool to return to their original position. The grooving tool 20 is then removed from the pipe and the pipe is ready for forming an interference fit joint as illustrated in FIG. 5**.

Figure 2:
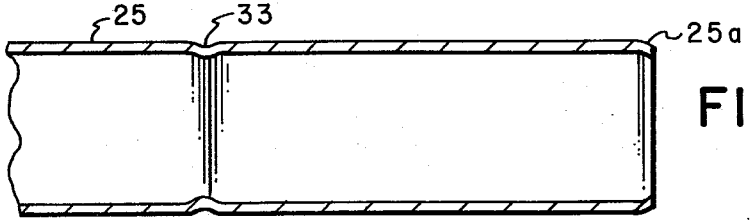
FIG. 2 is a sectional view of the pin end of a pipe sized and grooved in accordance with the invention.
Figure 5:
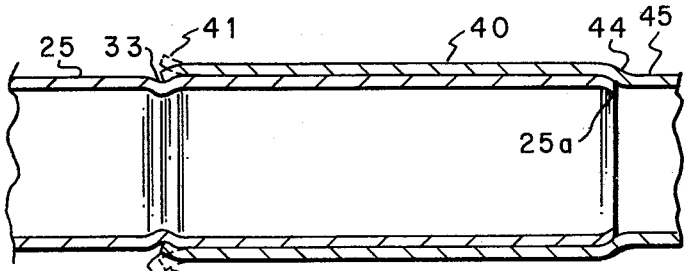
FIG. 5 is a sectional view of an interference fit joint formed using the pre-sized and pre-grooved pipe section illustrated in FIG. 2.

In forming the joint illustrated in FIG. 5, the pre-grooved and pre-sized pin end of pipe 25 as illustrated in FIG. 2 is telescopically forced into a bell 40 formed on the end of a mating pipe section 45. Bell 40 is formed by conventional methods, such as by forcing a mandrel (not shown) of the desired shape into the open end of pipe section 45 to form a bell 40 having internal dimensions slightly less than the external dimensions of the sized pin end. Conventionally, the mouth 41 (shown in phantom in FIG. 5) is slightly flared outwardly to assist in aligning the pin and bell as the pin is inserted within the bell. The pin is then forced into the bell until the tapered end 25*a* strikes the throat 44. Conventional lubricants, sealing agents, bonding agents and the like may be used in forming the interference fit joint, depending, of course, on the amount of interference, the material of the pipe and the material and type of liners, if any, in the pipe sections.

In the preferred embodiment of the invention, the lengths of sizing tool 10 and the mandrel forming the bell 40 are matched so that the mouth 41 of the bell is aligned with the groove 33 when the tapered end 25*a* strikes the throat 44. Thus, as the joint is assembled, the operator may visually observe that the joint is properly completed when the mouth 41 is aligned with the groove 33. When the joint is thus completed, the flared mouth 41 is radially inwardly compressed into groove 33 to form a mechanically interlocked interference fit joint. When forming interference fit joints with pipe having internal plastic liners, the depth of insertion of the pin into the bell is critical to insure that the ends of the plastic liners are properly mated or overlapped to form a continuously lined conduit. Where the groove 33 is formed at a predetermined distance from the open end of the pipe 25 and the depth of the bell 40 is directly related to such predetermined distance, liners may be formed within the pipe sections prior to joining the sections with the ends of the liners positioned so that a proper make-up between liners is insured when the mouth 41 of the bell 40 is aligned with the groove 33. Thus the operator need not measure insertion depth but may rely on visual observation to know that proper liner make-up is achieved when the groove 33 and mouth 41 are aligned.

All of the component parts of the sizing tool and grooving tool described hereinabove may be fabricated from conventional steel alloys. Since the fingers in the grooving tool must flex to be radially compressed and form the groove 33 and then return to their original position, it is preferrable that the cylindrical body 21 be formed from a high strength spring steel such as a vanadium steel alloy or the like. The sizes of each of the component parts will be determined, however, by the particular size of pipe to be sized and grooved. Likewise, other dimensions, such as depth of the groove, length of the bell, amount of interference, etc., will be determined by the material of the pipe, the pipe wall thickness, the intended purpose of the conduit formed, etc., all as is well known in the art.

Although not illustrated in the drawings, it will be appreciated that the pre-sized and pre-grooved pipe is particularly useful for use in joining lengths of lined pipe to form fully lined conduit. The lining, which is inserted into the pipe after the belling, sizing and grooving operations, may take various conventional forms. For example, the liners may be formed in place as by spraying a coating on the internal surface of the pipe or may be tubular liners inserted into the pipe and bonded to the internal surface of the pipe by known techniques. Various methods for forming such internal liners, as well as various methods of joining the ends of the liners within the joint to form a fully lined conduit therefrom, are well known in the art. One of the significant features of this invention, however, is that the mouth of the bell may be deformed into the groove 13 after a fully lined joint is formed to form a mechanically interlocked joint without disturbing the liner on the internal surface of the pipe.

Since the groove 33 is formed in the pipe section 25 prior to formation of a liner therewithin, the mouth 41 of the bell may be deformed into the groove 33 without disturbing the internal liner. Furthermore, since the mouth 41 is automatically aligned with the groove 33, the apparatus for deforming the mouth 41 inwardly need exert only sufficient pressure to deform the mouth of the bell. The apparatus need not and should not further deform the pin end of the pipe. However, deforming the mouth 41 radially inwardly into the pre-existing groove 33 mechanically interlocks the pipe sections 25 and 45 together to produce a mechanically sound joint which will usually withstand internal pressures as great or greater than the pressure capacity of the pipe sections.

From the foregoing it will be observed that the grooving tool described cooperates with the sizing tool to form a groove in the pin end of the pipe at a desired distance from the open end. Various conventional apparatus are available for exerting the required axial pressures on the sizing tool and the grooving tool described. For example, pipe press apparatus of the type conventionally used for sizing and belling operations may be used. Likewise, apparatus conventionally used for forming interference fit joints may be used in forming joints in accordance with the invention; and various methods are conventionally available for deforming the mouth 41 into the groove 33. Accordingly, while the invention has been described with particular reference to specific embodiments thereof, it will be readily understood that the forms of the invention shown and described in detail are to be taken as preferred embodiments of same. Various changes and modifications thereof may be resorted to without departing from the spirit and scope of the invention as defined by the appended claims.

What is claimed:

1. Apparatus for forming an annular recess in the external surface of a pipe comprising:

(a) a first cylindrical body concentrically positionable and axially moveable over said pipe, said cylindrical body having an internal diameter in at least the central portion thereof larger than the external diameter of said pipe;

(b) an inwardly projecting lip on the internal surface of said cylindrical body adjacent one end thereof with the external diameter of said first body increasing axially from said one end thereof forming a tapered external surface adjacent said one end thereof;

(c) a plurality of axial slots in said cylindrical body extending through said lip; and (d) means for radially compressing said one end of said cylindrical body whereby said lip is pressed into and forms an annular groove in said pipe, said means for radially compressing said one end of said first cylindrical body comprising a ring surrounding said pipe, said ring having a tapered internal surface mating with said tapered external surface when said tapered external surface is axially telescoped within said ring wherein said ring is a sizing ring maintained within a sizing tool, the smallest internal diameter of said sizing ring corresponding to the desired external diameter of said pipe.

2. Apparatus as defined in claim 1 wherein said sizing ring is maintained within a sizing tool having an end tapering ring positioned at a predetermined axial distance therefrom, said predetermined axial distance corresponding to the desired distance between the open end of said pipe and the annular recess in the external surface of said pipe formed by said lip.

3. Apparatus for sizing the pin end of a section of pipe and forming an annular groove in the external surface of said pipe at a predetermined distance from the open end thereof comprising:

(a) a pipe sizing tool, said sizing tool including a sizing ring near one end thereof and means for limiting the length of pipe which may be axially forced through said sizing tool near the opposite end thereof, said sizing ring comprising a ring with a tapered internal diameter decreasing in diameter from a diameter larger than the external diameter of said pipe at the edge thereof nearest said one end of said sizing tool to the desired external diameter of said pin end of said pipe;

(b) a pipe grooving tool comprising an elongated cylindrical body concentrically slideable over said pipe section, said cylindrical body having an internal diameter adjacent both ends thereof substantially corresponding to the external diameter of said pipe and having a larger internal diameter in the central portion thereof, said grooving tool further having a tapered external diameter adjacent one end thereof and axial slots extending through said tapered external diameter; and (c) means for forcing said tapered external diameter portion of said pipe grooving tool axially into said sizing ring whereby the slotted portion of said grooving tool is radially inwardly compressed to form an annular groove in the external surface of said pipe section.

4. Apparatus as defined in claim 3 wherein said means for limiting the length of pipe which may be axially forced through said sizing ring is a ring with a tapered internal diameter which forms an inwardly tapered end on the open end of said pipe section.

5. Apparatus as defined in claim 3 wherein said means for limiting the length of pipe which may be axially forced through said sizing ring is positioned at a predetermined axial distance from said sizing ring and the axial distance between the limiting means and said sizing ring is directly related to the desired axial spacing of said annular groove from the open end of said pipe.

6. The method of forming an annular recess in the external surface of a section of malleable pipe at a predetermined distance from the open end thereof comprising the steps of:

(a) positioning a grooving tool concentrically about said pipe, said grooving tool comprising a cylindrical body with an inwardly projecting lip on the internal surface thereof adjacent one end thereof and a tapered external surface adjacent said one end thereof and further including axial slots extending through said tapered external surface and said lip;

(b) forcing a predetermined length of said pipe through a sizing ring having a tapered internal diameter;

(c) maintaining said sizing ring at a predetermined distance from the open end of said pipe; and (d) moving said grooving tool axially into said sizing ring whereby said tapered external surface mates with said tapered internal diameter to radially compress said one end of said grooving tool and deform said inwardly projecting lip into said pipe, thereby forming an annular groove in the external surface of said pipe.

* * * * *